US006237519B1

(12) United States Patent
Azulay

(10) Patent No.: US 6,237,519 B1
(45) Date of Patent: May 29, 2001

(54) TAPE FEEDER FOR A STITCHING MACHINE

(75) Inventor: Meir Azulay, Misgav (IL)

(73) Assignee: R.M.D. Robotics Ltd., Benei Brak (IL)

( * ) Notice: Subject to any disclaimer, the term of this patent is extended or adjusted under 35 U.S.C. 154(b) by 0 days.

(21) Appl. No.: 09/583,544

(22) Filed: Jun. 1, 2000

(30) Foreign Application Priority Data

Jun. 3, 1999 (IL) ..... 130275

(51) Int. Cl.[7] ..... D05B 27/10; D05B 35/06

(52) U.S. Cl. ..... 112/470.33; 112/152

(58) Field of Search ..... 112/152, 470.33, 112/305, 322, 113, 470.31, 141, 304, 307, 318, 284, 220; 74/417, 416, 423, 385

(56) References Cited

U.S. PATENT DOCUMENTS 2,231,648 * 2/1941 Weis ..... 112/470.33
3,856,224 * 12/1974 Van der Aa et al. ..... 112/470.33
4,020,776 5/1977 Haff, Jr. .
4,590,874 * 5/1986 Baclagis ..... 112/470.33 X
5,222,989 6/1993 Hyca .
5,269,257 12/1993 Yamazaki .
5,400,729 * 3/1995 Bryant ..... 112/470.33 X
5,410,975 * 5/1995 Dudek et al. ..... 112/470.33 X

* cited by examiner

*Primary Examiner*—Ismael Izaguirre
(74) *Attorney, Agent, or Firm*—Oliff & Berridge, PLC

(57) ABSTRACT

A tape feeder for feeding elasticizer tape to a stitching machine adapted for stitching the elasticized tape onto a textile workpiece, the tape feeder comprising a tensioning assembly comprising a tensioning assembly comprising a gearbox fitted with a first shaft and a second shaft substantially orthogonal to one another and rotationally coupled to one another via suitable first coupling mechanism and a first roller. A presser mechanism comprising a second roller mounted onto a releasable bracket such that the first and second roller are maintained essentially parallel and biased towards one another for grippingly passing elasticized tape therebetween in response to rotation of one of the rollers. The first and second shaft have a free end for selectively coupling to a suitable driving member. And a mounting structure mountable onto the stitching machine, for supporting the gearbox assembly in either a first position and a second position being in substantially orthogonal relation to one another.

16 Claims, 4 Drawing Sheets

TAPE FEEDER FOR A STITCHING MACHINE

FIELD OF THE INVENTION

The present invention relates to a device for feeding elasticated tape to a textile workpiece in a stitching machine, in particular such a device adapted for feeding tape thereto in either a vertical feed or a horizontal feed. Hereinafter in the specification and claims, the terms "stitching" and "sewing" are used interchangeably.

BACKGROUND OF THE INVENTION

Feeding devices for elasticized strips of material adapted for stitching onto a base material are well known. In some applications, a stitching machine is used for stitching elastic strips that are prefolded over circular parts of garments, such as, for example, the waist or leg openings of briefs or panties. A tape feeder is used to feed the elasticized tape to the stitching machine in a controlled manner, such as to selectively and differentially elasticise the circular parts as desired. It will be appreciated however, that the invention is not restricted to stitching circular parts.

There are many known stitching machines in which an elastic strip feeder is mounted such as, for example, the Yamato VF2429S-140S-1/AU20/AEF-1, in which the tape feeder comprises a tensioning mechanism vertically displaced with respect to the bed and the presser foot of the machine. The tensioning mechanism comprises a feed roller driven by a servomotor such as a stepper motor, for example, and a parallel holding roller, the rollers having their axes of rotation in horizontal parallel arrangement. Elasticized tape is fed from a spool vertically above the tensioning mechanism and threaded between the feed roller and the holding roller. The tape is then passed to a horizontal folding device which folds the elastic tape over a portion of the circular part of the workpiece or garment to be stitched together.

The length of elastic strip between the tensioning mechanism and the part of the garment to be stitched is kept in tension. The amount of tension is controlled by altering the rate of feed of the elastic tape through the tensioning mechanism by means of the stepper motor, relative to the rate of feed of the folded elastic strip on the garment at the stitching station. The stepping motor is typically computer controlled. The amount of tension in the tape determines the amount of stretching thereof, and, therefore, the degree of pleating or creasing of the material onto which the tape is stitched once the tension is removed and the tape returns to its unloaded state.

However, this system suffers from a number of problems. For example, as the stepper motor changes speed, the resulting acceleration and deceleration affects the tension in the elastic strip. This change in tension needs to be compensated for, since otherwise the stitch density, and therefore the degree of elastication, (and therefore of pleating or creasing) of each portion of the circular part of the circular garment will be different than desired. Compensation for the varying tension is usually performed manually using an iteration method involving periodically checking the stitch density over a particular tubular component of one garment and performing a correction for the next garment.

Also, the elastic tape is longitudinally folded in two, and downstream thereof the part of the garment to be stitched with the folded elastic strip is horizontally fed to the presser foot at the stitching station. In the aforesaid prior art machines, the elastic tape is vertically fed to the tensioning mechanism and has to be passed through two 90° turns in order to be properly fed to the folding and stitching stations. In order to accommodate these two turns, the distance between the tensioning mechanism and the stitching station has been traditionally large.

Further, maintenance of the tape feeder is difficult due to low accessibility thereto, and typically the whole tape feeder assembly has to be unscrewed and dismounted from the stitching machine. More so, access to the footer zone (e.g. for inserting thread, etc) and maintenance of the presser foot or folding device is even more difficult since these components are blocked by the feeder assembly, which must therefore also be removed from the stitching machine in order to effect such maintenance.

U.S. Pat. No. 5,222,989 to Ilyca discloses a tape feeder comprising a motor driven roller and a parallel presser roller. In one mode of operation, these two rollers are brought together and tape pinched therebetween can be advanced to the stitching station and thus acts as a tensioning mechanism. U.S. Pat. No. 5,269,257 to Yamazaki is directed to the problem of the overlapping length of the tape tail end of the sewing front portion. A tape feeder is disclosed as part of the machine described therein. The tape feeder comprises a feed roller rotated by a motor and a holding roller. Tape pinched between these two rollers can be advanced to the stitching station and thus acts as a tensioning mechanism.

U.S. Pat. No. 4,020,776 discloses a vertically fed feeder comprising parallel rollers, and the feeder is carried on a pivotal bracket lockably secured to the base of the stitching machine.

None of these patents addresses the problems raised herein.

It is therefore an aim of the present invention to provide a device that overcomes or substantially reduces the above limitations of prior art tape feeder devices. In particular, it is an object of the present invention to provides a versatile tape feeder that enables the distance between the tensioning mechanism and the stitching station to be substantially reduced and where it may be turned by 90° by a simple operation to enable elastic tape to be fed horizontally or vertically, from a spool. The present invention also comprises means for swinging away the tensioning mechanism from the stitching machine for easy operator access thereto and to the presser foot and folding device.

SUMMARY OF THE INVENTION

According to the present invention there is provided. A tape feeder for feeding elasticized tape to a stitching machine adapted for stitching the elasticized tape onto a textile workpiece, said tape feeder comprising:

a tensioning assembly comprising:

- a gearbox assembly comprising a first shaft and a second shaft substantially orthogonal to one another and rotationally coupled to one another via suitable first coupling mechanism;
- a first roller rotatably mounted onto said gearbox assembly and being coaxially coupled with said first shaft;
- a presser mechanism comprising a second roller rotatably mounted at one axial end thereof onto a bracket releasably mounted onto said gearbox assembly, such that the first and second roller are maintained essentially parallel to one another and said second roller is biased towards said first roller;
- said first and second rollers adapted to grippingly pass elasticized tape therebetween in response to rotation of one said first and second roller;

each one of the first and second shaft has a free end adapted to be selectively coupling to a suitable driving member for rotation therewith;

a mounting structure mountable onto the stitching machine, said mounting structure adapted for supporting said gearbox assembly in either a first position and a second position being in substantially orthogonal relation to one another, wherein at the first position and said second positions the axis of at least said first roller is oriented substantially horizontally and vertically, respectively.

By an embodiment of the present invention, the tape feeding device is retrofittable to existing stitching machines of the type concerned.

The device is relatively simple mechanically and is simple to install and thus is economic to produce as well as to maintain.

The design of the device is such that the counter-rotating parallel rollers are of short axial lengths which allow as close as possible access of the device to the vicinity of the foot of the stitching machine.

The tensioning mechanism is supported by a cantilevered support arm that can be mounted onto the stitching machine at any one of a plurality of possible locations, thus enabling the total distance between this component and the stitching station to be reduced further, and to be easily displaced to allow access for threading and servicing.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF A SPECIFIC EMBODIMENT

The present invention relates to a tape feeder device for feeding elasticized tape to a stitching or sewing machine that is adapted for stitching elasticized tape onto a textile workpiece. Typically, the machine is adapted for stitching a textile tape onto a circular edge, such as the waist or leg opening, or a tubular textile workpiece, such as briefs, panties and swimsuits, for example. Nonetheless, the tape feeder of the present invention may be used for feeding non-textile and non-elasticized tape, for example plastic or leather tape, as well as for feeding elasticized tape, to stitching machines used for stitching tape to other non-tubular textile workpieces such as, for example, collar and cuffs of garments, or borders for curtains, and so on. In the case of non-elasticized tape, the velocity of the stepper motor is matched to the rate of feed of the workpiece at the stitching station.

Figure 1:
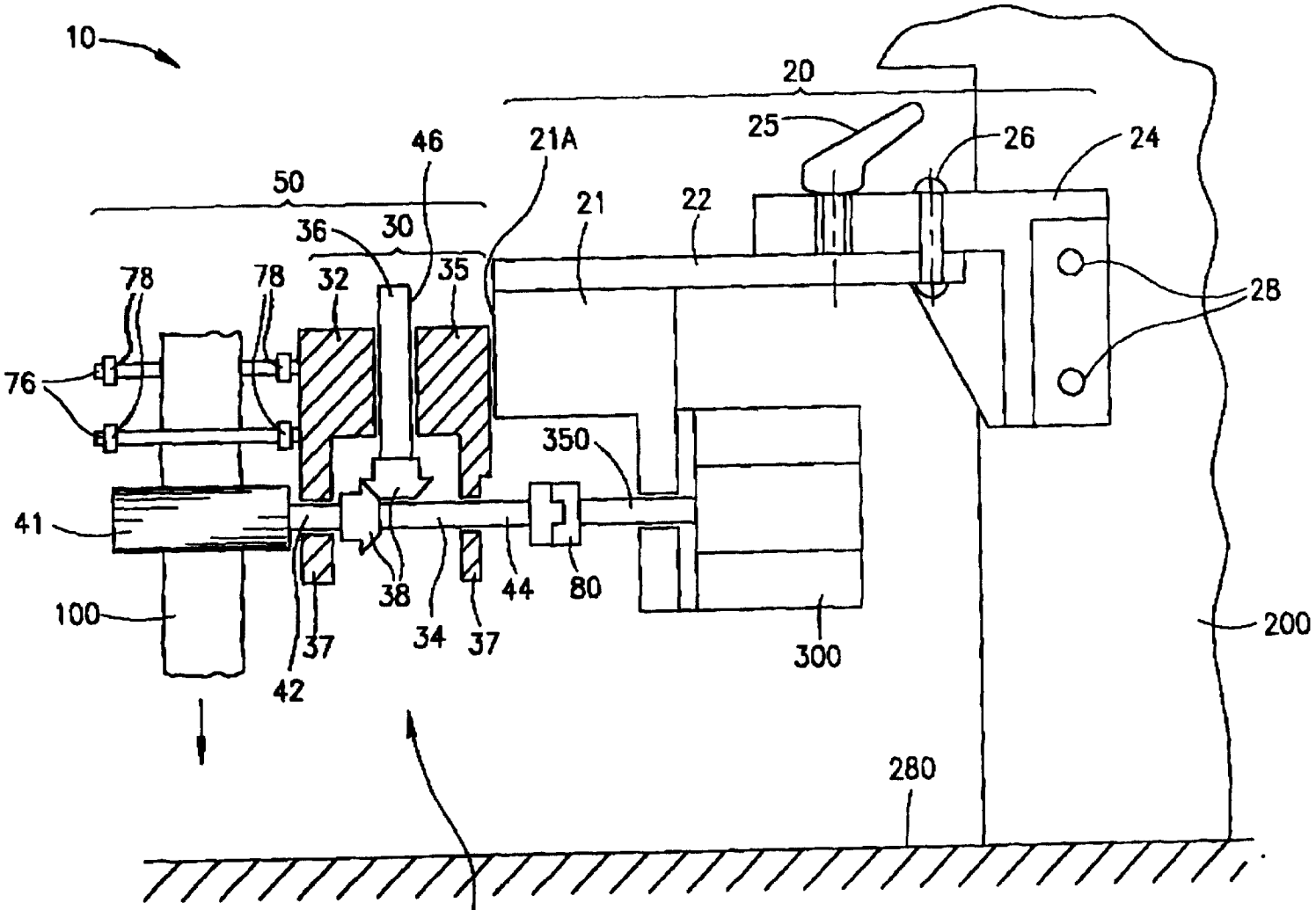
FIG. 1 is a side elevational partial cross-sectional view, illustrating a preferred embodiment of the present invention, mounted onto a stitching machine and adapted for feeding tape vertically.
Figure 2:
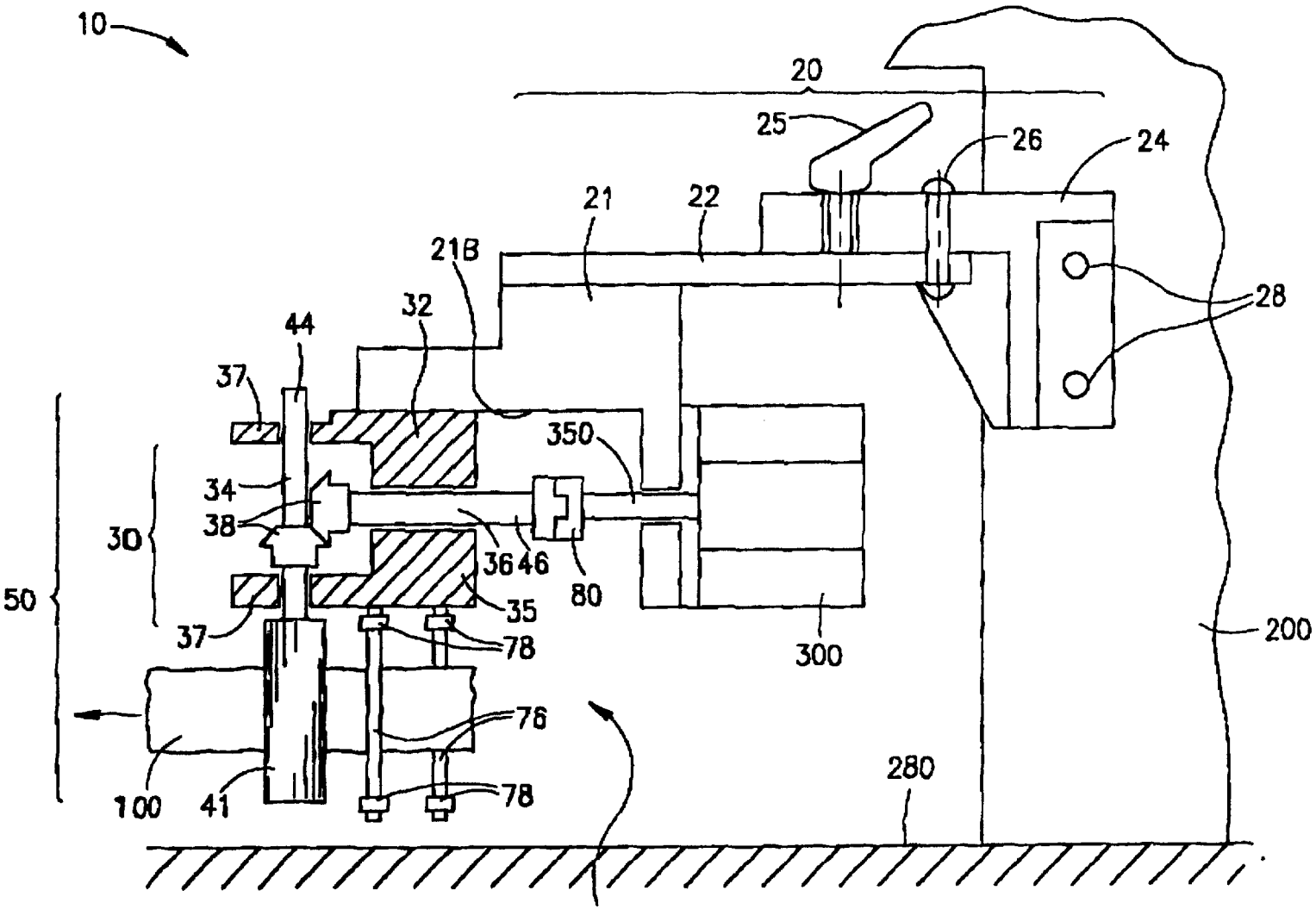
FIG. 2 is a side elevational partial cross-sectional view, illustrating a preferred embodiment of the present invention mounted, onto a stitching machine and adapted for feeding tape horizontally.

FIGS. 1 and 2 illustrate a preferred embodiment of the present invention, configured for feeding tape or stripping vertically and horizontally, respectively. The device, generally designated by reference numeral 10, comprises a mounting structure collectively designated 20, and a tensioning mechanism collectively designated 50. The tensioning mechanism 50 is selectively mountable in one of two, substantially orthogonal, positions with respect to the said mounting structure 20 such as to enable tape or stripping 100 to be fed vertically or horizontally to a textile workpiece suitably held in the stitching machine 200, as illustrated in FIGS. 1 and 2, respectively.

The stitching machine typically also comprises a presser foot (not shown) downstream of the tape feeder device 10, comprising a sewing or stitching needle which moves up and down to stitch the tape 100 onto the workpiece carried on or close to the bed 280 of the stitching machine 200.

In the preferred embodiment, the mounting structure 20 is cantilevered onto any desired part of the stitching machine 200, and comprises a base plate 22 pivotally secured onto a mounting bracket 24 by any suitable pivoting means 26 such as a pivot screw, a hinge or the like. The mounting bracket 24 is releasably and securely mountable to a side of the stitching machine 200 by suitable means such as screws or bolts 28. The base plate 22 is releasably lockable with respect to the mounting bracket 24 by any suitable means, including for example, a quick release thumbscrew, wing nut or clamping lever 25 mounted to the base plate 22 and operating in an arcuate slot (not seen) comprised in the mounting bracket 24. By releasing lever 25, the base plate 22 may be swung about pivot 26 substantially over a horizontal plane, such as to expose the stitching area 250 of the machine 200 and provide access to the presser foot of the stitching machine, as well as to the side of the tape feeder 10 facing the stitching machine 200, also for servicing. A suitable adaptor 21 is mounted onto the underside of the base plate 22 for mounting thereon the said tensioning mechanism 50, as will be described in more detail hereinbelow, though the tensioning mechanism 50 may also be directly mounted onto the base plate 22 if desired.

Figure 4:
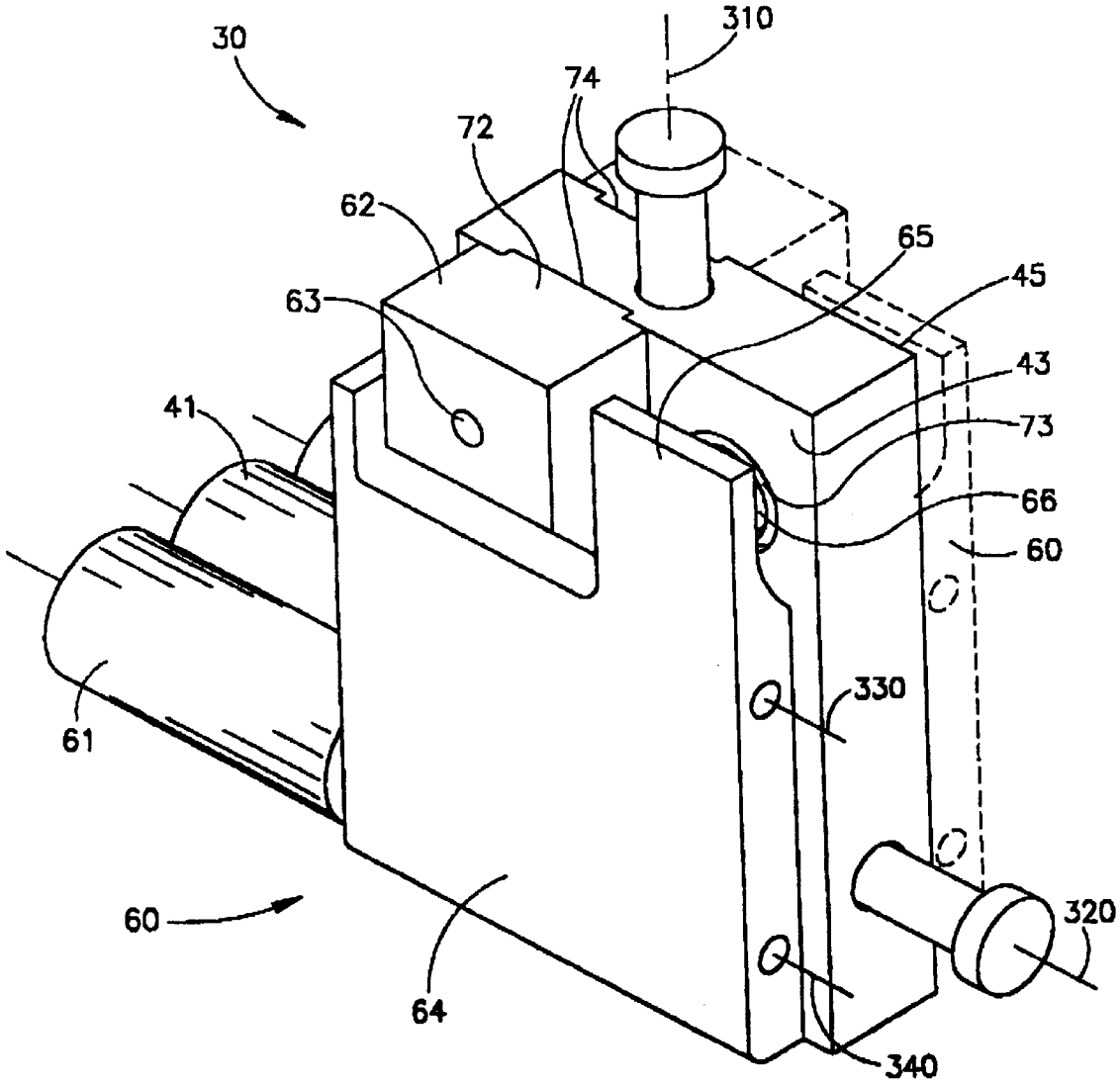
FIG. 4 shows in perspective view the gearbox of FIG. 2 with the presser device mounted on one face thereof.

The tensioning mechanism 50 comprises a gearbox generally designated 30 and a presser device generally designated 60, seen in detail in more FIG. 4. The gearbox 30 has a U-shaped bracket 32 having a bar portion 35 and two parallel arms 37 extending orthogonally therefrom, said bracket 32 having a first shaft 34 and a second shaft 36 rotatably mounted therein by any suitable means such as journals or bearings (not shown). The first shaft 34 is mounted across the arms 37 of the bracket 32 near the free ends of the arms 37, and the second shaft 36 is mounted substantially perpendicularly to the bar 35 of the U-shaped bracket 32. The first shaft 34 is rotatably coupled to the second shaft 36 via suitable first coupling means 38, in substantially orthogonal arrangement therewith. In other words, the bracket 32 is such as to enable the first shaft 34 to be rotationally coupled with the second shaft 36, wherein the axes of the first and second shafts are at 90° to one another.

The first coupling means 38 comprises first and second bevel gears suitably mounted to or integral with said first and second shafts 34, 36, respectively, wherein the said first bevel gear is adapted for meashing with said second bevel gear. Alternatively, said first coupling means 38 comprises a pinion and a crown gear suitably mounted or integral with said first and second shafts, 34 and 36, respectively, or said second and first shafts, 36 and 34, respectively, said pinion gear adapted for meshing with said crown gear.

In the preferred embodiment, the first shaft 34 and second shaft 36 each comprise one free end, 44 and 46 respectively, projecting out of said bracket 32, the first shaft 34 further comprising a second free end 42 also projecting out of the bracket 32. Alternatively, though, any of the free ends 44, 46 and 42 may be configured such as not to project out of the said bracket 32.

A first, knurled roller 41 is rotatably mounted at one axial end thereof onto the gearbox 30, said first roller 41 being rotationally coupled with free end 42 of said first shaft 34, being substantially coaxial with respect thereto. Preferably, said first roller 41 is integral with said second free end 42, for rotation therewith. Alternatively, said first roller 41 may be rotatably mounted onto said bracket 32 in coaxial but juxtaposed relation to said shaft 34 and rotatably coupled thereto by any suitable means such as a suitable gear train or belt drive, for example.

Figure 3:
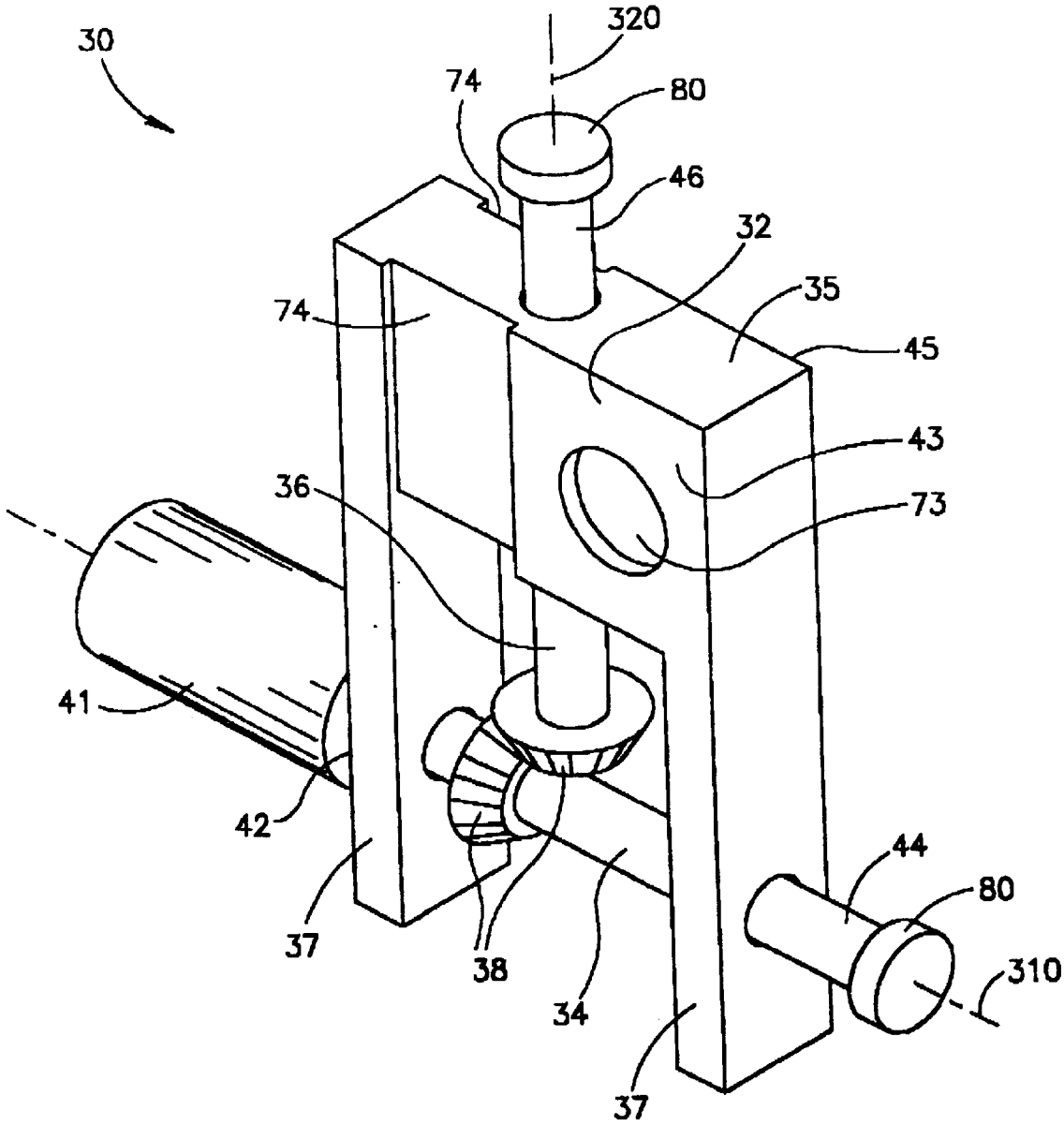
FIG. 3 shows in perspective view, the gearbox of the embodiment shown in FIGS. 1 and 2.

Further attention is directed now also to FIGS. 3 and 4. The bracket 32 of gearbox 30 has opposed first and second faces 43 and 45 substantially parallel to the plane comprising the axes of rotation 310, 320 of said first and second shafts 34, 36, respectively. The presser device 60 (FIG. 4) comprises a mounting block 62 releasably mountable to one of said faces, 43 or 45, say first face 43 as illustrated in FIG. 4, by any suitable means such as a screw 63, for example. The mounting block 62 comprises a suitable bracket 64 pivotally mounted thereto about an axis 330 in substantial parallel arrangement with the axis 320 of said first shaft 34. The bracket 64 supports a second knurled roller 61 rotatably mounted at one free axial end thereof to the base of bracket 64 in parallel orientation with respect to axis 330, by any suitable means such as journals or bearings. The axis 340 of rotation of said second roller 61 is in substantial parallel arrangement with respect to the axis 320 of said first shaft 34, and therefore also to the pivot axis 330 of the said bracket 64.

The mounting block 62 is aligned with said gear box 30 by means of a rail or rib 72 and complementary groove 74 arrangement, for example, such that the said second roller 61 is in juxtaposition with respect to the first roller 41, as illustrated in FIG. 4. Thus, as the bracket 64 is pivoted alternately clockwise and counterclockwise about said pivot axis 330, the second roller 61 is laterally brought into contact and separated from, respectively, said first roller 41. The bracket 64 comprises at least one arm 65 extending approximately perpendicular to said pivot axis 330 and away from the direction of the axis 340 of the second roller 61. A suitable pre-compressed spring 66, accommodated between the arm 65 and a well 73 comprised on the first face 43, positively urges arm 65 away from said first face 43, thus biasing the second roller 61 into pressing tangential contact with said first roller 41.

Preferably, as shown in FIGS. 1 and 2, at least two parallel pins 76 are mounted onto the mounting block 62 in parallel arrangement with said first roller 41 and said second roller 61 for aligning tape 100 therewith. Each pin 76 optionally comprises movable stops 78 for limiting lateral displacement of the tape 100. Optionally, the presser device 60 is integral with said gearbox 50, and in particular said mounting block 62 is integral with one of said faces 43 or 45 of said bracket 32.

As mentioned above, the second face 45 is formed with a groove 74 and a well 73 and alternatively, the presser device 60 may be mounted on the second face 45 of the bracket 32, as illustrated by the phantom lines shown in FIG. 4, in a similar manner to that described with respect to said first face 43, *mutatis mutandis*. In such a case, the precise shapes of the bracket 64 and of the mounting block 62 required for the second face 45 may be corresponding mirror-images of those required for the said first face 43.

Thus, a length of tape 100 may be inserted between said first roller 41 and said second roller 61 by first pressing said arm 65 against the bias of the spring 66, pivoting said bracket 64 and separating the second roller 61 from the first roller 41. Release of said arm 65 results in said tape 100 being grippingly held between said first roller 41 and said second roller 61. Said tape 100 may then be fed through the rollers by rotating either one or both of said first roller 41 and said second roller 61.

Preferably, the tensioning mechanism 50 is mounted onto a suitable adaptor 21 (see FIGS. 1 and 2), which is in turn mounted to the underside of base plate 22. The precise form of the adaptor 21 need not be the same when the tensioning mechanism 50 is used for vertically feeding tape 100 as for it is used for horizontally feeding tape 100, and in fact different adaptors 21 may be used according to specific needs. Thus, as shown in FIG. 1 by way of example, adaptor 21 may comprise a vertical face 21*a* for mounting one of the arms 37 of gearbox 30 thereonto by any suitable means such as screws, for example.

However, when the device 10 is to be used in horizontal feed mode, a different adaptor 21 may be used comprising a horizontal should 21*b* having a horizontal face for mounting one of the arms 37 of gearbox 30 thereonto by any suitable means such as screws, for example, as illustrated in FIG. 2.

Moreover, it may be necessary in some applications to have the gearbox 30, and thus rollers 41 and 61, at varying horizontal and/or vertical distances from the stitching area 250 of the machine 200, for example, and this may be accommodated by providing a series of brackets 21 adapted to provide the appropriate displacements with respect to the base plate 22, which in turn is preferably maintained mounted onto the machine 200 at the same location by means of mounting bracket 24. Alternatively, the gearbox 30 and adaptor 21 may be configured such as to be mutually compatible in two orthogonal orientations, and thus enable to the gearbox 30 to be mounted onto the same adaptor 21 in either one of vertical and horizontal feeding modes of positions.

The tape 100 is advanced by means of said first roller 41 and second roller 61. Said first roller 41 is driven directly or indirectly by a suitable motor 300, which is typically a servo motor and preferably a stepper motor. Said second roller 61 counter-rotates with respect to said first roller 41 by virtue of tangential contact therewith directly or indirectly via tape 100 fed therebetween, as a result of friction forces developing therebetween.

Motor 300 is controlled by suitable control means (not shown), such as a microprocessor for example, and preferably powered electrically. The motor 300 may thus be driven at a rate corresponding to, or faster than, or slower than, the speed of the stitching machine advancing the workpiece, and thus enable the required pretensioning to be achieved for each section of the tape 100 as it leaves the rollers 41, 61 and is stitched onto the workpiece.

Preferably, the motor 300 is also mounted onto the mounting structure 20, in particular the adaptor 21, such that the driveshaft 350 of the motor 300 may be directly coupled by suitable second coupling means 80 to the said first shaft 34 or to the said second shaft 36, as illustrated in FIGS. 1 and 2, respectively. Said second coupling means 80 may comprise, for example, an Oldham coupling, any suitable axial coupling means, or a universal joint.

Alternatively, the motor 300 may be mounted directly onto the base plate 22, or onto the mounting bracket 24, or be comprised in the stitching machine 200 itself, and operatively connected to said first shaft 34 or said second shaft 36 via any suitable means such as for example a flexible drive and said second coupling means 80.

The tape feeding device 10 may be thus be mounted onto a stitching machine 200 by means of mounting bracket 24 at any suitable location thereon, preferably as close as possible to the bed 280 and to the stitching area 250 of the machine 200. The tape feeding device 10 may thus be considered a retrofit item with respect to existing stitching machines, as well as an integral component of new stitching machines. The gearbox 30 may be mounted onto the adaptor 21 in one of two mutually orthogonal positions:

(1) Vertical feed position—in which the said first shaft 34 is oriented in a substantially horizontal direction, and directly coupled to the motor shaft 350 by means of said second coupling means 80; or (2) Horizontal feed position—in which the said first shaft 34 is oriented in a substantially vertical direction, and indirectly coupled to the motor shaft 350 by means of said first coupling means 38, said second shaft 36 and said second coupling means 80.

The presser device 60 is then mounted onto the gearbox 30 on whichever face 43 or 45 is more convenient. The form of the adaptor 21 may also be chosen in each occasion such as to minimise, or simply modify, to some extent the distance between the rollers 41, 61 and the stitching area 250. Thus, the user is able to choose for any given application, the direction of feed of the tape 100, either horizontally or vertically, as well as the distance between the rollers 41, 61 and the area of the workpiece to be stitched. In this manner, the tension in the length of tape 100 between the rollers 41, 61 and this area of the workpiece may be precisely controlled in relation to the speed of the motor 300. At any time, the mounting structure 20 enables the base plate 22, together with the tensioning assembly 50 and the motor 300, to be swung away from the stitching area 250 about said pivoting means 26, by releasing or opening said lever 25, thereby providing access to the stitching area 250, and also enabling the gearbox 30 to be dismounted and remounted in a different feed mode or position if required.

While in the foregoing description describes in detail only a few specific embodiments of the invention, it will be understood by those skilled in the art that the invention is not limited thereto and that other variations in form and details may be possible without departing from the scope and spirit of the invention herein disclosed.

What is claimed is:

1. A tape feeder for feeding elasticized tape to a stitching machine adapted for stitching the elasticized tape onto a textile workpiece, said tape feeder comprising:

a tensioning assembly comprising:

a gearbox assembly comprising a first shaft and a second shaft substantially orthogonal to one another and rotationally coupled to one another via suitable first coupling mechanism;

a first roller rotatably mounted onto said gearbox assembly and being coaxially coupled with said first shaft;

a presser mechanism comprising a second roller rotatably mounted at one axial end thereof onto a bracket releasably mounted onto said gearbox assembly, such that the first and second roller are maintained essentially parallel to one another and said second roller is biased towards said first roller;

said first and second rollers adapted to grippingly pass elasticized tape therebetween in response to rotation of one said first and second roller;

each one of the first and second shaft has a free end adapted to be selectively coupling to a suitable driving member for rotation therewith;

a mounting structure mountable onto the stitching machine, said mounting structure adapted for supporting said gearbox assembly in either a first position and a second position being in substantially orthogonal relation to one another, wherein at the first position and said second positions the axis of at least said first roller is oriented substantially horizontally and vertically, respectively.

2. A tape feeder as claimed in claim 1, wherein the driving member is a motor operatively connected to a suitable controller and to a suitable power source, said motor comprising a shaft rotatable at a controllable angular velocity; the shaft adapted to be operatively connectable to either one of the free end of the first shaft or second shaft; the mounting structure further adapted for supporting said motor thereon such that when said gearbox assembly is mounted onto said mounting structure in any one of the said first position or said second position, with said first shaft or said second shafts, respectively, being coupled for mutual rotation with said motor via a second coupling mechanism.

3. A tape feeder as claimed in claim 1, wherein the mounting structure comprises a first portion adapted for mounting onto the stitching machine and a second portion adapted for mounting the gearbox means thereon; said first portion being lockably pivotable about said second portion such that when the mounting structure is suitably mounted to the stitching machine, the second portion may be swung away from the stitching machine.

4. A tape feeder as claimed in claim 3, wherein the second portion comprises a base plate and an adapter mounted to the underside thereof.

5. A tape feeder as claimed in claim 4, wherein the driving member is mounted onto said adaptor of said mounting structure.

6. A tape feeder as claimed in claim 1, wherein the gearbox assembly comprises a U-like shaped bracket having two parallel arms extending orthogonally from a connecting bar, where the first shaft is mounted across the arms of the bracket adjacent a free end thereof, and the second shaft is mounted to the said connecting bar, substantially orthogonally thereto.

7. A tape feeder as claimed in claim 1, wherein the presser mechanism is integral with the gearbox assembly.

8. A tape feeder as claimed in claim 1, wherein the presser mechanism comprises a biasing spring for urging the second roller towards the first roller in a direction orthogonal to the axes of the first and second roller.

9. A tape feeder as claimed in claim 1, wherein the first and second roller each comprise a free end, said free ends being in substantially juxtaposed parallel arrangement.

10. A tape feeder as claimed in claim 1, wherein the first coupling mechanism comprises a first bevel gear and a second bevel gear suitably mounted or integral with said first and second shafts, respectively, said first bevel gear adapted for meshing with the second bevel gear.

11. A tape feeder as claimed in claim 1, wherein the first coupling mechanism comprises a pinion and a crown gear suitably mounted or integral with the first and second shafts, respectively, said pinion gear adapted for meshing with said crown gear.

12. A tape feeder as claimed in claim 1, wherein the second coupling mechanism is an axial coupling mechanism.

13. A tape feeder as claimed in claim 12, wherein the second coupling mechanism is an Oldham coupling.

14. A tape feeder as claimed in claim 1, wherein the second coupling mechanism is a universal joint.

15. A tape feeder as claimed in claim 6, further comprising an aligning arrangement comprising parallel pins extending from the gearbox assembly, said pins mounted in substantially parallel arrangement with respect to the rollers, for aligning tape therebetween.

16. A tape feeder as claimed in claim 1, wherein the distance of the first and second rollers from a feeding foot of the stitching machine does not exceed about 40 mm.

* * * * *